US005566403A

United States Patent [19]

Black et al.

[11] Patent Number: 5,566,403

[45] Date of Patent: Oct. 22, 1996

[54] SPA COVER LIFT APPARATUS

[76] Inventors: Marc S. Black, 3240 Val Verde Ave., Long Beach, Calif. 90808; Jeffrey D. Black, 4281 Candleberry Ave., Seal Beach, Calif. 90740

[21] Appl. No.: 301,257

[22] Filed: Sep. 6, 1994

[51] Int. Cl.[6] ..... E04H 4/06

[52] U.S. Cl. ..... 4/498; 4/580; 220/264; 49/386

[58] Field of Search ..... 4/498, 503, 580, 4/246.5; 220/264, 335; 49/386; 180/69.21

[56] References Cited

U.S. PATENT DOCUMENTS

| | | | |
|---|---|---|---|
| 3,516,095 | 6/1970 | Clifton et al. | 4/246.5 |
| 3,896,595 | 7/1975 | Anghinetti et al. | 49/386 X |
| 4,208,840 | 6/1980 | Jentoft et al. | 49/386 X |
| 4,857,374 | 8/1989 | Perry | 428/71 |
| 4,899,420 | 2/1990 | Bye et al. | 49/386 X |
| 4,991,238 | 2/1991 | Forrest | 4/498 |
| 5,086,525 | 2/1992 | Christopher | 4/498 |
| 5,131,102 | 7/1992 | Salley et al. | 4/498 |

OTHER PUBLICATIONS

"Tubcap" brochure of Centech Corp., Aug. 1989, 4 pages.

*Primary Examiner*—Robert M. Fetsuga
*Attorney, Agent, or Firm*—Fulwider Patton Lee & Utecht

[57] ABSTRACT

A spa cover lifting apparatus which can be adjusted to accommodate spa covers of different sizes and which can be attached to the spa cover without damaging said spa cover or requiring special fastening means. The spa cover lifting apparatus mounts on the spa frame and raises the spa cover from its horizontal engagement position to a vertical position freeing the spa for use. The lifting action of the apparatus being assisted by a telescoping gas strut.

7 Claims, 3 Drawing Sheets

SPA COVER LIFT APPARATUS

FIELD OF THE INVENTION

This invention relates to the field of lifting devices for lifting and removing covers for spas and hot tubs.

BACKGROUND OF THE INVENTION

Spas and hot tubs have long been utilized by people for relaxation and physical therapy. To allow for optimal enjoyment and utilization of a spa or hot tub it is desirable that dirt, leaves and other types of debris be prevented from falling into the water to the greatest extent possible. Additionally, since spas and hot tubs are heated in normal use, it is desirable to reduce as much as possible the heat loss from the heated water to the surrounding atmosphere. A reduction of heat loss results in a reduction of the spa owner's energy bill to heat the spa.

To address the problems of debris in the water and heat loss, spa owners have long utilized covers for their spas. The spa covers are generally sized and configured to completely cover the spa. To prevent or reduce heat loss, they are typically formed of an insulating material, such as foam, encased within a waterproof cover. Commonly, the covers are formed of two half sections connected by a folding seam or joint formed in the waterproof cover. This construction allows one half of the cover to be folded back on the other half when removing the cover from the spa. Although, satisfactorily dealing with the problems of debris and heat loss, the spa covers created a new problem due to their size and bulkiness. Spas and hot tubs commonly have diameters of up to eight (8) feet or more. Covers large enough to cover spas of this size create problems in terms of removal of the cover to allow access to the spa and storage or placement of the cover once it is removed. Due to their size and weight, it frequently requires two individuals to remove the spa cover without it dragging on the ground. When the spa covers come into contact with the ground they potentially can pick up debris and their useful life span can be severely shortened due to undesired wear and tear on the cover.

Prior attempts to deal with the problem of handling of the spa covers have been directed towards devices which still require excessive effort on the part of the individual user or designs limited in application to a specific spa cover. Prior devices are illustrated in U.S. Pat. No. 4,991,238 to Forrest and U.S. Pat. No. 4,857,374 to Perry.

The Forrest patent, U.S. Pat. No. 4,991,238 is directed to a device which is mounted on the side of the spa enclosure. This device requires that an open space equal to at least one half the diameter of the spa cover be provided on the side of the spa upon which the device is mounted. It also requires that the spa user push or pull the spa cover off of the spa and onto the device. In addition to problems of space constraint, the Forrest device also presents problems to the elderly or to small individuals who are unable to handle the spa cover without the assistance of another individual.

The Perry patent, U.S. Pat. No. 4,857,374 is directed to a spa/hot tub cover which is utilized in connection with a gas spring apparatus to assist in the lifting of the spa cover. The device of the Perry patent is not adjustable and can only be used in connection with a particular spa cover. As illustrated in Perry, the spa cover is hinged to the spa frame and the gas spring assembly is rigidly fastened to the side of the spa cover. This type of construction requires a special plastic cover or layer on the waterproof cover to provide the rigidity necessary for a durable connection.

Given the shortcomings of these prior devices, a need exists for a spa cover lifting apparatus which can be mounted on the spa or spa frame without regard to external space available about the spa. A need also exists for a spa cover lifting apparatus which can be utilized with a variety of spa covers and does not require any external connections between the spa cover and the spa frame or rigid connections between the apparatus and the cover.

SUMMARY OF THE INVENTION

The subject invention provides a spa cover lifting device which can be utilized with a variety of spa and/or hot tub covers. In the context of the subject invention the term spa is interchangeable with the term hot tub and references to a "spa" are equally applicable to "hot tub."

The subject invention comprises a mounting bracket which is fastened to the spa housing or frame. An adjustable or telescoping lifting arm is pivotally connected at its fixed or non-adjustable end to the mounting bracket. A pair of engagement arms are positioned at the opposite end of the lifting arm. The engagement arms extend perpendicularly from the lifting arm and are spaced apart both latitudinally and longitudinally.

The standard or common spa cover, regardless of the size and/or configuration of the specific spa is typically comprised of two half-sections joined together by a hinged joint which allows one half of the cover to be folded back upon the other half. Typically, each half section, which is constructed from an insulating foam, is encased within a durable, waterproof material such as vinyl. The hinged joint is normally formed by means of a reinforced seam in the vinyl covering connecting the two sections.

The engagement arms of the subject invention are inserted along the hinged joint in the spa cover such that, when viewed from the side with the cover lying in a horizontal plane atop the spa, one of said engagement arms is positioned above or on top of the hinged portion of the spa cover and the second engagement arm is positioned underneath the hinged joint between the two half sections. This construction allows for a non-invasive or non-rigid connection between the lifting device and the spa cover.

A support cylinder is provided between the mounting bracket and an intermediate point on the lifting arm. The support cylinder is preferably a gas strut which assists in lifting the cover, holding it in place when raised and cushioning its downward release.

In operation, two of the lifting devices are commonly utilized, one being mounted on each side of the spa. When it is desired to raise the cover, the front section of the spa is folded back on top of the rear section. The user then raises up on the lift assembly and the lifting arm, assisted by the gas shock, raises to a vertical position. The extended gas shock then serves to maintain the device in the raised position. In this position the spa cover is suspended vertically from the engagement arms leaving the spa completely free and unobstructed for use by the owner.

To lower the cover, the user simply pulls down on the lifting arm and returns the arm to a horizontal position. During this lowering process the gas shock serves to provide a cushioning or braking force to allow the controlled lowering of the cover. Once the cover is lowered, the rear section of the spa cover is in place over the spa. The user then unfolds the front section of the cover onto the remaining portion of the spa.

BRIEF DESCRIPTION OF THE DRAWINGS

The various aspects, advantages, and novel features of the subject invention will be more clearly understood from the following detailed description when read in conjunction with the appended drawings, in which.

DETAILED DESCRIPTION OF THE PREFERRED EMBODIMENT

Figure 1:
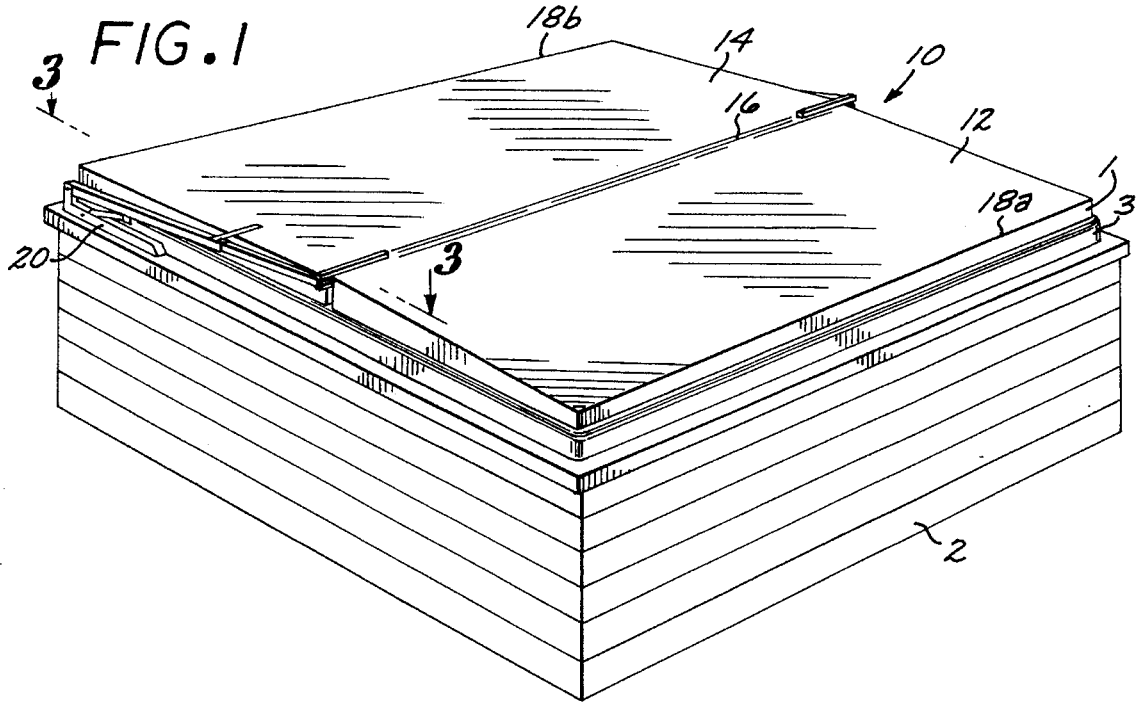
FIG. 1 is a perspective view of the spa lifting apparatus of the subject invention deployed in a closed position.

The spa cover lifting device of the subject invention is illustrated in accompanying FIGS. 1–9. The various elements of the device are designated by reference numerals which are commonly utilized throughout the various views of the invention illustrated in the drawings.

Figure 2:
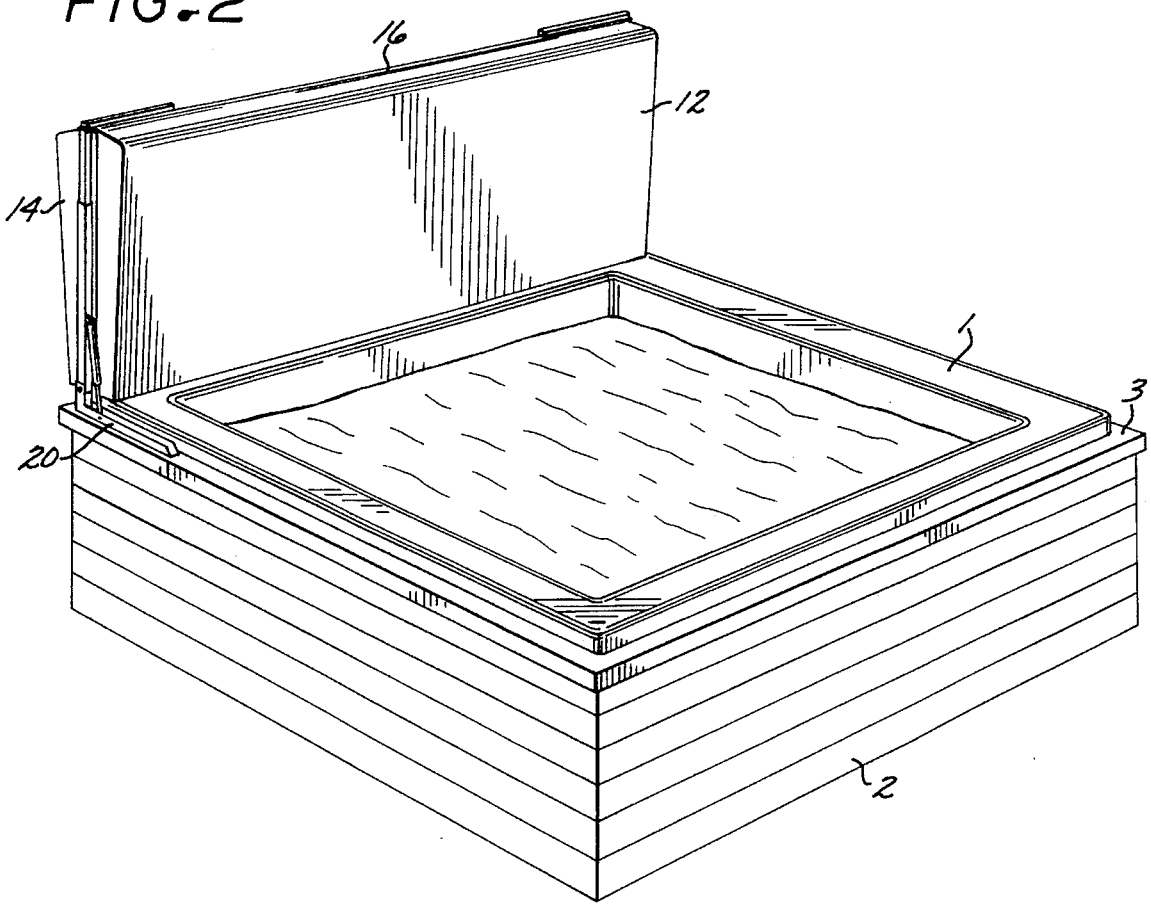
FIG. 2 is a perspective view of the spa lifting apparatus of the subject invention deployed in the raised position.

Turning initially to FIG. 1 and FIG. 2, the subject spa cover lifting device is shown mounted on a spa and spa cover combination in a closed position, FIG. 1, and a raised position, FIG. 2.

Typically, a spa 1 is formed from fiberglass or a high strength molded plastic. When actually installed it is placed or enclosed within a spa frame 2. The frame provides an enclosure around the spa body and a rim 3 around the edge of the spa 1. Typically, the spa frames are constructed out of wood. However, it is to be understood that the subject invention may be utilized in connection with spas and spa frames constructed from any variety of materials known to those skilled in the art.

As shown in FIG. 1, the spa cover 10 typically consists of two sections or halves 12 and 14 joined together by a seam 16 formed in the covering material or fabric of the cover 10. To insulate against heat loss the spa cover 10 is normally several inches thick and is formed from any of the many known insulating foams commercially available. The cover 10 is thicker at the center point along the seam 16 and tapers slightly towards the outer edges 18*a* and 18*b*. A typical spa cover may have a thickness of 4 inches at the center adjacent seam 16 and a thickness of 2.25 inches of the outer edges 18*a* and 18*b*. This taper allows for runoff of rainwater and prevents standing pools of water from forming on the cover.

As shown in FIG. 2 when in use, the subject spa cover lifting device serves to first raise the spa cover 10 off of the spa and secondly retain the spa cover 10 in an upright position providing complete, unrestricted access to the spa.

The construction and operation of the subject invention will now be described in detail in connection with FIGS. 3–9.

Figure 6:
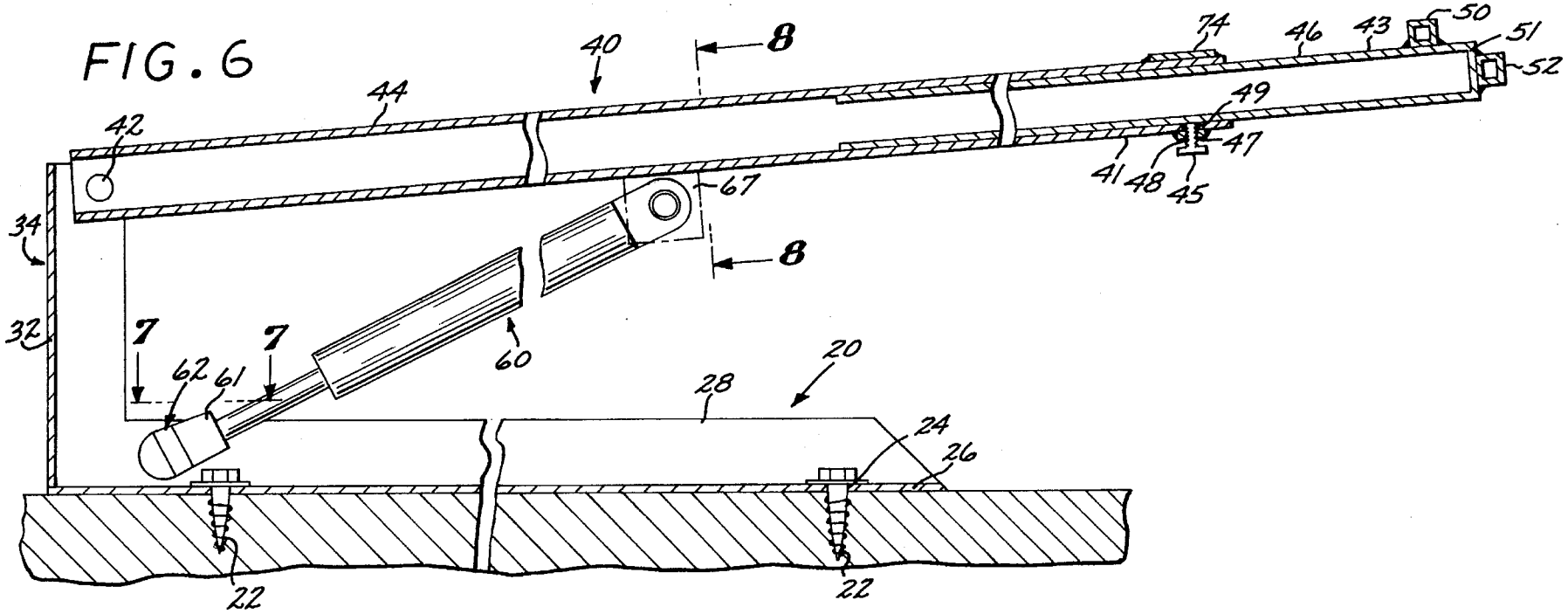
FIG. 6 is a cross-sectional side view of the subject invention, taken along line 6—6 of FIG. 3.

With specific reference to FIG. 6, the components of the invention are described herein. A mounting bracket 20 is provided for mounting the spa cover lifting device to the spa frame 2. As shown in FIG. 6, the bracket 20 is mounted to the frame 2 by means of a plurality of wood screws 22 inserted through mounting apertures 24 in the base 26 of bracket 20. As illustrated in the drawings, in a first embodiment bracket 20 is mounted on the rim 3 of the frame 2. In those instances in which the rim 3 is not of a width sufficient to accommodate the mounting of bracket 20, a side mount bracket (not shown) may be utilized. In this embodiment, the side mount bracket is mounted to the side wall of spa frame 2. Bracket 20 is then mounted on the side mount bracket. In a preferred embodiment bracket 20 is a channel bracket having opposing lateral walls 28 and 30 and rear wall 32.

Bracket 20 also includes vertical arm or extension 34. In the preferred embodiment, arm 34 is a height slightly less than the combined thickness of the spa lip and spa cover 10. As discussed, a typical spa cover is approximately 2.25 inches thick at its outer edge and a typical spa extends 3 inches above the frame.

Adjustable lifting arm 40 is pivotally connected to the end of vertical arm 34 at pivot point 42. Lifting arm 40 is comprised of a pivot arm 44 and a telescoping arm 46. As shown in FIG. 6, pivot arm 44 is a rectangular cross-sectioned tube and telescoping arm 46 is slidably positioned with pivot arm 44. Locking screw 45 is provided for locking telescoping arm 46 in the desired position. In a preferred embodiment locking screw 45 is threaded through locking nut 47 which is welded to the lower outer wall 41 of lifting arm 40. The aperture 48 in nut 47 is aligned with aperture 49 in outer wall 41. Other adjustable or telescoping configurations obvious to those in the an may be used without departing from the scope of the subject invention.

Figure 3:
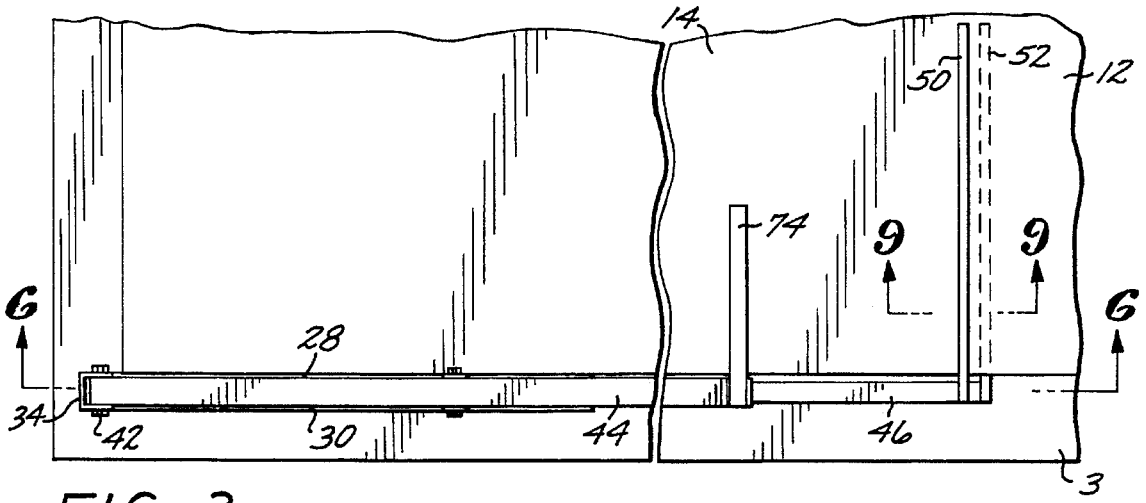
FIG. 3 is a partial top view of the spa lifting apparatus of the subject invention in a closed position, taken along line 3—3 of FIG. 1.

Engagement arms 50 and 52 are provided at the distal end of telescoping arm 46. Engagement arm 50 is corrected to the upper surface 43 of telescoping arm 46 while engagement arm 52 is connected to the front end 51 of arm 46. As illustrated in FIG. 3, engagement arms 50 and 52 extend perpendicularly in an inward direction, with respect to the spa cover, from arm 46.

Figure 7:
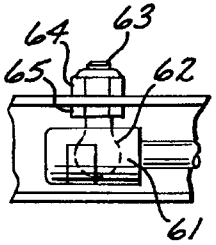
FIG. 7 is a partial top section view of the lower support member connector of the subject invention.

A telescoping support member 60 is provided between mounting bracket 20 and pivot arm 44. One end of support member 60 is pivotally connected to pivot arm 44. In a preferred embodiment both pivot connections are made by standard ball stud connectors as shown in more detail in FIGS. 7 and 8. A ball stud 62 is mounted on wall 28 of bracket 20. A female receptacle 61 is mounted on the end of support member 60 which receives ball stud 62. As shown in FIG. 7, in a preferred embodiment, ball stud 62 is connected to wall 28 by means of its threaded end 63 being inserted through aperture 65 and retained in place by nut 64.

The opposite end of support member 60 is pivotally connected to pivot arm 44 in a similar manner. Ball stud 66 is connected to a bracket 67 extending downward from arm 44. A female receptacle 68 is provided of the end of arm 44 for receiving ball stud 66. The threaded end 69 of ball stud 66 extends through an aperture 70 in bracket 67 and is retained in place by nut 72.

It is to be understood that other types of pivoting or rotating connections may be utilized for connecting support member 60 to bracket 20 and pivot arm 44.

In a preferred embodiment, support member 60 is a gas strut. The strength of the strut can be varied depending upon the size of the spa. For example, a 250 newton gas shock or strut is suitable for a seven foot diameter spa, while a 400 newton strut will be used for an eight foot diameter spa. Similarly, for spa covers incorporating a denser material, a 500 newton gas strut would be utilized in connection with an eight foot diameter spa.

Figure 4:
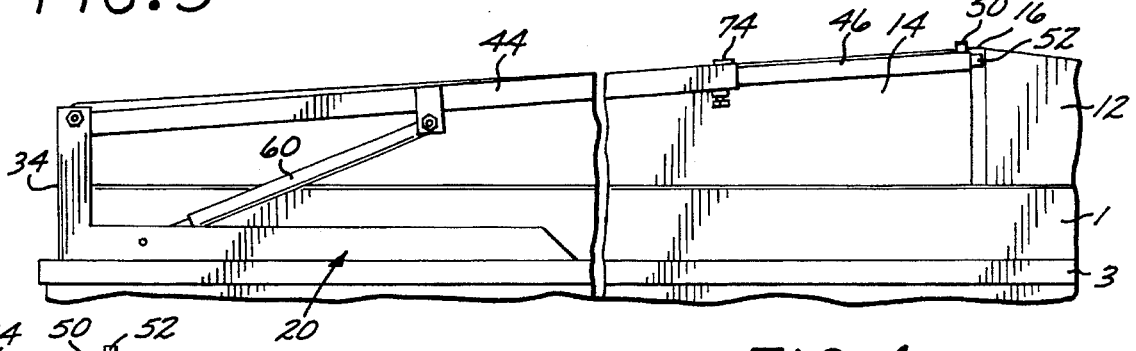
FIG. 4 is a partial side view of the spa lifting apparatus of the subject invention in a closed position.
Figure 9:
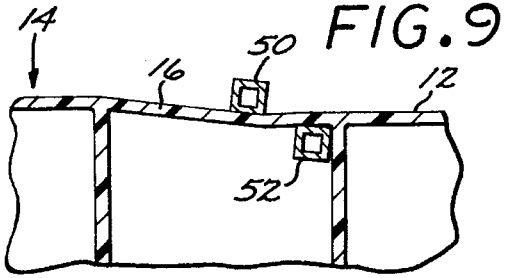
FIG. 9 is a partial cross-section side view of the lift assembly engagement member taken along line 9—9 of FIG. 3.
Figure 8:
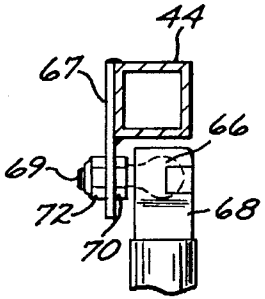
FIG. 8 is a partial front view of the upper support member of the subject invention, taken along line 8—8 of FIG. 6.

The connection of the subject invention to a spa cover is illustrated in FIGS. 3, 4, and 9. As shown in FIG. 3, the engagement arms 50 and 52 are inserted along seam 16 with arm 50 being positioned above the cover and arm 52 below the cover. The positioning of arms 50 and 52 is shown in greater detail in FIG. 9, which is not drawn to scale. Arms 50 and 52 engage seam 16 and provide a non-invasive and non-rigid connection.

To allow for its utilization in connection with spa covers of differing sizes, the subject spa cover lifting device is adjustable by means of telescoping arm 46 previously described. Arm 46 is drawn outward from within pivot arm 44 to a position where engagement arms 50 and 52 are aligned with seam 16. Arm 46 is then locked in this position by means of locking screw 45.

As shown in FIGS. 1 and 2, in normal operation a pair of the lifting devices are utilized with one of the devices being positioned on each side of the spa.

Figure 5:
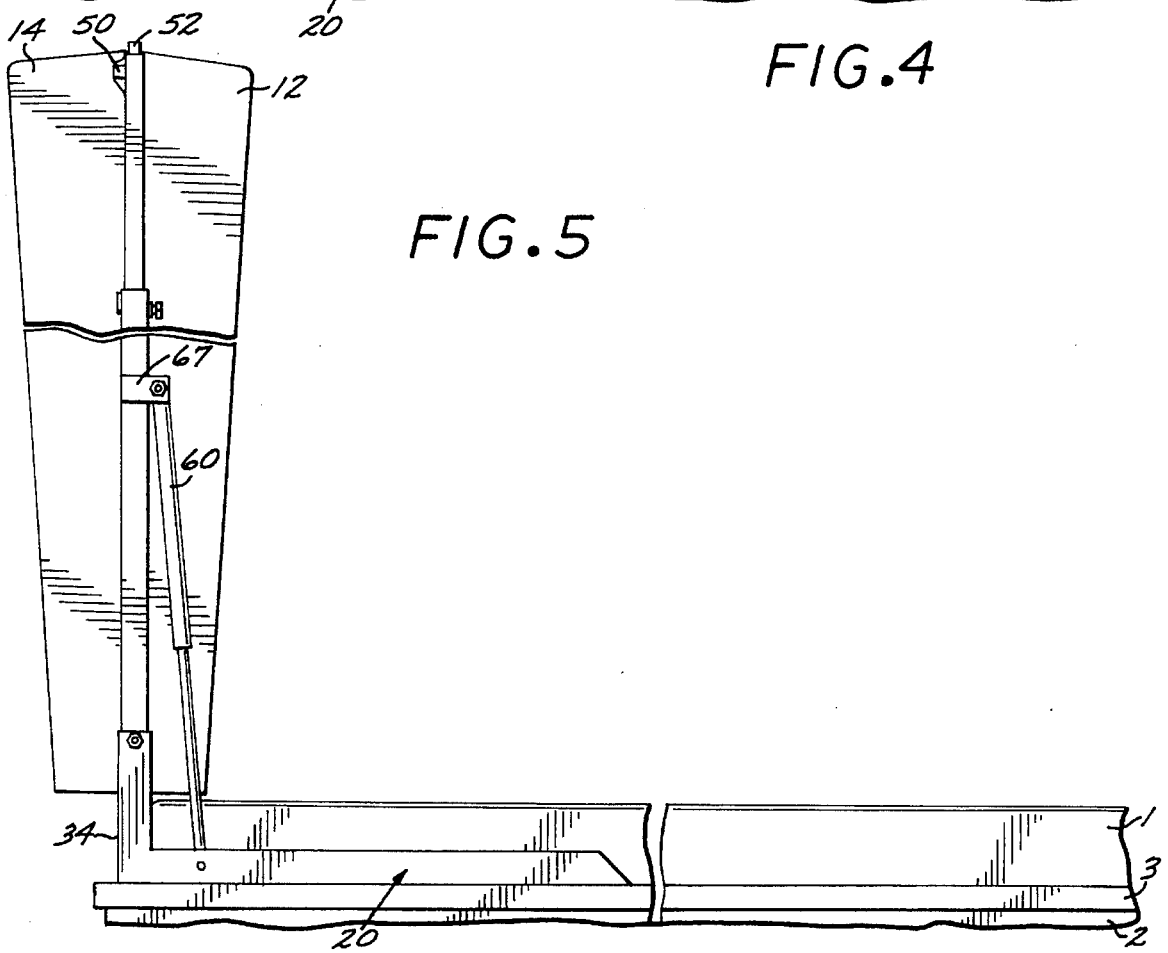
FIG. 5 is a side view of the spa lifting apparatus of the subject invention in an open or upright raised position.

To remove the spa cover 10, one simply folds the front section 12 backwards over engagement arm 44 so that it lays on top of rear section 14. Then the user raises up on lifting arm 40 until the spa cover is raised to a vertical position as shown in FIG. 5. To prevent the two spa cover sections 12 and 14 from swinging about arm 44, stabilizer arm 74 is provided on pivot arm 44. Stabilizer arm 74 is positioned between sections 12 and 14 when the spa cover is folded over upon itself.

Having described the preferred embodiments of the subject invention, it is to be understood that the scope of the said invention is not to be limited to the specific embodiment described and illustrated herein but is to be accorded the full breadth and scope of the appended claims.

What is claimed is:

1. An adjustable spa cover lifting apparatus for lifting a spa cover off of a spa comprising:

a pair of lifting assemblies wherein each of said lifting assemblies includes:

a mounting bracket;

an adjustable lifting arm pivotally connected at one end to said mounting bracket;

a stabilizer arm positioned at an intermediate point on said adjustable lifting arm;

a support member having proximate and distal ends, said proximate end being pivotally connected to said mounting bracket and said distal end being pivotally connected to said adjustable lifting arm; and a spa cover engagement assembly positioned on said adjustable lifting arm.

2. The adjustable spa cover lifting apparatus of claim 1 wherein:

said adjustable lifting arms comprise hollow outer bodies and inner bodies longitudinally adjustable within the respective said hollow outer bodies, said adjustable lifting arms further comprising locking means for locking said inner bodies in position with respect to said hollow outer bodies.

3. A spa cover and adjustable spa cover lifting assembly for lifting a spa cover off of a spa comprising:

a spa cover;

a pair of lifting assemblies mounted on opposite sides of said spa cover, wherein each of said lifting assemblies includes:

a mounting bracket;

an adjustable lifting arm pivotally connected at one end to said mounting bracket;

a support member having proximate and distal ends, said proximate end being pivotally connected to said mounting bracket and said distal end being pivotally connected to said adjustable lifting arm;

an engagement assembly positioned on said adjustable lifting arm, wherein each of said engagement assemblies engages a hinged seam in said spa cover; and a stabilizer arm positioned at an intermediate point on said adjustable lifting arm.

4. A spa cover and adjustable spa cover lifting assembly for lifting a spa cover off of a spa comprising:

a spa cover;

a pair of lifting assemblies mounted on opposite sides of said spa cover, wherein each of said lifting assemblies includes:

a mounting bracket;

an adjustable lifting arm pivotally connected at one end to said mounting bracket wherein said adjustable lifting arm comprises a hollow outer body and an inner body longitudinally adjustable relative to said hollow outer body and further comprising locking means for locking said inner body in position with respect to said hollow outer body;

a support member having proximate and distal ends, said proximate end being pivotally connected to said mounting bracket and said distal end being pivotally connected to said adjustable lifting arm; and an engagement assembly positioned on said adjustable lifting arm, wherein each of said engagement assemblies engages a hinged seam in said spa cover.

5. The spa cover and adjustable spa cover lifting assembly of claim 4 wherein:

the respective said engagement assemblies comprise first and second engagement arms extending perpendicularly from the respective said adjustable lifting arms.

6. The spa cover and adjustable spa cover lifting assembly of claim 5 wherein:

the respective said first and second engagement arms are spaced apart in both latitudinal and longitudinal directions.

7. The spa cover and adjustable spa cover lifting assembly of claim 4 wherein:

said support members comprise telescoping gas struts.

* * * * *

UNITED STATES PATENT AND TRADEMARK OFFICE

CERTIFICATE OF CORRECTION

PATENT NO. : 5,566,403

DATED : Oct. 22, 1996

INVENTOR(S) : Marc S. Black
Jeffrey D. Black

It is certified that error appears in the above-identified patent and that said Letters Patent is hereby corrected as shown below:

Column 4, line 34, delete "an" and insert - - art - -.

Signed and Sealed this

Twenty-fifth Day of February, 1997

Bruce Lehman

*Attest:*

BRUCE LEHMAN

*Attesting Officer*

*Commissioner of Patents and Trademarks*